US007066271B2

(12) United States Patent
Chen et al.

(10) Patent No.: US 7,066,271 B2
(45) Date of Patent: Jun. 27, 2006

(54) EXPANDED DOWNHOLE SCREEN SYSTEMS AND METHOD

(75) Inventors: ChenKang David Chen, Houston, TX (US); Daniel David Gleitman, Houston, TX (US); M. Vikram Rao, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 233 days.

(21) Appl. No.: 10/721,042

(22) Filed: Nov. 24, 2003

(65) Prior Publication Data

US 2005/0109510 A1 May 26, 2005

(51) Int. Cl.
*E21B 23/02* (2006.01)

(52) U.S. Cl. ..... 166/380; 166/207; 175/61

(58) Field of Classification Search ..... 166/380, 166/384, 207; 175/61, 73, 75
See application file for complete search history.

(56) References Cited

U.S. PATENT DOCUMENTS

| | | | | |
|---|---|---|---|---|
| 4,828,053 | A | 5/1989 | Maurer et al. | |
| 5,441,119 | A | 8/1995 | Head | |
| 5,513,714 | A | 5/1996 | Downie et al. | |
| 5,520,256 | A | 5/1996 | Eddison | |
| 5,853,053 | A | 12/1998 | Gilchrist et al. | |
| 5,857,531 | A | 1/1999 | Estep et al. | |
| 5,901,789 | A | 5/1999 | Donnelly et al. | |
| 6,269,892 | B1 | 8/2001 | Boulton et al. | |
| 6,457,532 | B1 * | 10/2002 | Simpson | 166/380 |
| 6,470,977 | B1 | 10/2002 | Chen et al. | |
| 6,571,871 | B1 | 6/2003 | Lauritzen et al. | |
| 6,581,699 | B1 | 6/2003 | Chen et al. | |
| 2004/0074640 | A1 * | 4/2004 | Anderton et al. | 166/277 |
| 2004/0149431 | A1 * | 8/2004 | Wylie et al. | 166/242.1 |
| 2004/0211570 | A1 * | 10/2004 | Chen et al. | 166/382 |

OTHER PUBLICATIONS

Expandable Tubular Solutions, Fillippov et al, 1999, SPE 56500.*

* cited by examiner

*Primary Examiner*—William Neuder
(74) *Attorney, Agent, or Firm*—Browning Bushman P.C.

(57) ABSTRACT

An improved system and method is disclosed for expanding a fluid permeable tubular downhole in an open hole completion. A high quality borehole is first drilled using a bottom-hole assembly having a long gauge bit and a short bit-to-bend ratio. A fluid-permeable tubular is then inserted into an open-hole portion of the wellbore and preferably expanded in place. The expandable tubular may include an external filtering medium. Hydrocarbons may pass from the formation through the expanded fluid permeable tubular and into the borehole, to be recovered.

32 Claims, 6 Drawing Sheets

EXPANDED DOWNHOLE SCREEN SYSTEMS AND METHOD

FIELD OF THE INVENTION

The invention relates to a system and method to expand tubular screens in an open-hole wellbore to recover hydrocarbons from subterranean formations.

BACKGROUND OF THE INVENTION

Oil and gas wells are drilled with a wellbore into which tubular segments, such as steel casing, may be inserted and installed. Fluid-permeable tubular members or "screens" are frequently used in the production zone of an open-hole wellbore to recover hydrocarbons from subterranean formations. Screens permit fluid to pass from such fluid-bearing formations into a tubular string for recovery.

Screens may be expanded in the wellbore in much the same way that conventional tubulars such as casing may be expanded. Expandable sand screen ("ESS") generally consists of a perforated or slotted base pipe, and may include woven filtering material and a protective, perforated outer shroud. Both the base pipe and the outer shroud are expandable. The woven filter is typically arranged over the base pipe in sheets that partially cover one another and slide across one another as the ESS is expanded. Expandable sand screens are commonly used to replace open-hole gravel packs to improve production. An arrangement of sand screen is described in U.S. Pat. Nos. 5,901,789 and 6,571,871.

A number of disadvantages are known in the art. One major problem associated with existing screen expansion techniques is commonly referred to as "spiraling." Poor hole quality associated with spiraling makes borehole cleaning and screen installation more difficult. Spiraling increases the drag and limits the length of screen that can be installed. If the borehole is not straight or "gauge", the screen will not be placed in intimate contact with the formation. Any annulus between the screen and wellbore will significantly reduce the benefits associated with an expandable screen completion.

The disadvantages of existing expandable screen systems and methods are overcome by the invention, and an improved expanded downhole screen system and method are hereinafter disclosed.

SUMMARY OF THE INVENTION

An improved system and method are disclosed for expanding fluid-permeable tubular members or "screens" in an open-hole wellbore to recover hydrocarbons from subterranean formations. According to one aspect of this invention, deviated borehole sections may be drilled with improved borehole quality, characterized in part by reduced borehole spiraling. This allows for easier insertion of the tubular. The tubular may then be expanded within the borehole.

There are significant advantages associated with this method. The invention leads to a lower expansion ratio of the tubular, which minimizes any reduction in mechanical properties of the screen, such as collapse strength. A larger tubular may be used to reduce the amount of expansion required, achieving expansion ratios of less than approximately 15%, and preferably less than 10%. Such reduced expansion requires less axial force to expand the screen and results in better post-expansion collapse strength. Typically, the screen is expanded to a point where its outer wall places a stress on the interior wall of the wellbore, thereby providing support to the walls of the wellbore. Once expanded, the space between the screen and the wellbore may largely be eliminated, along with the need for a large gravel pack otherwise required to fill the annular space with particulate to support the formation and maintain permeability. Because less pressure is used in the installation of the fluid-permeable tubular, it is more reliable, efficient, and durable.

The present method is further preferable to existing technologies because it results in a higher production yield, has lower drawdown, allows for a larger internal diameter for intervention work, and simplifies installation.

These and further features and advantages of this invention will become apparent from the following detailed description, wherein reference is made to the figures in the accompanying drawings.

DETAILED DESCRIPTION OF PREFERRED EMBODIMENTS

Figure 1:
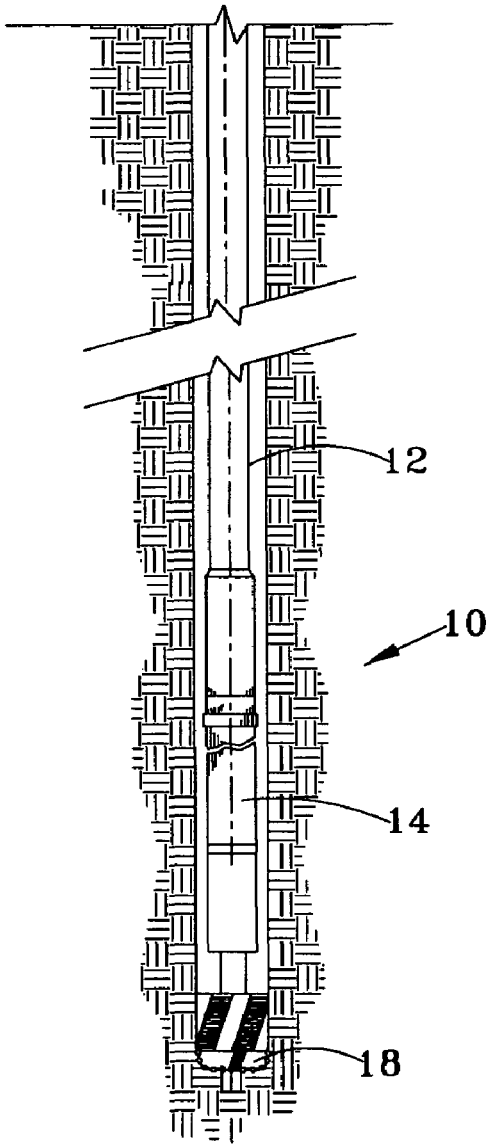
FIG. 1 generally illustrates a well drilled with a bottom hole assembly (BHA) at the lower-end of a drill string and a downhole motor with a bit.
Figure 2:
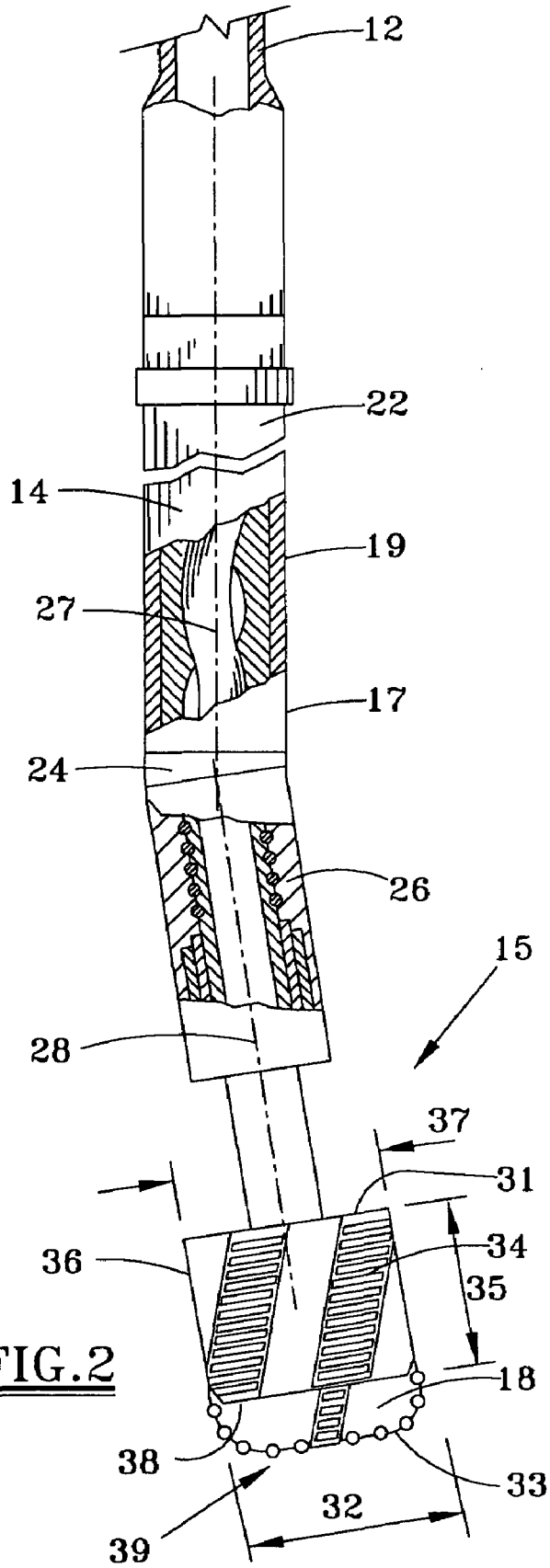
FIG. 2 illustrates a BHA in greater detail.

FIG. 1 generally illustrates drilling a straight section of a well, with a bottom hole assembly (BHA) 10 positioned at the lower end of a drill string 12. The BHA 10 includes a fluid powered downhole motor 14 for rotating a bit 18 during drilling. FIG. 2, by contrast, illustrates a BHA configured for drilling a deviated portion of a well. The motor 14 for drilling deviated portions of the well may be a "positive displacement motor" (PDM) having a lobed rotor. In most cases, the PDM is a "bent housing motor" (BHM), typically having a bend 24 of less than 3 degrees. The bend 24 of a PDM is between the upper power section having rotational axis 27 and a lower bearing section having rotational axis 28 in the motor housing, so that the axis 28 for the bit 18 is offset at the selected bend 24 from the axis 27. The lower bearing section 26 includes a bearing package assembly which conventionally comprises both thrust and radial bearings. The PDM 14 may be run "slick", meaning that the motor housing 17 has a substantially uniform diameter from the upper power section 22 through the bend 24, and to the lower bearing section 26, as shown in FIG. 2. The motor housing may include a slide or wear pad 19.

A straight and vertical section of a well may be drilled with a straight pipe string. A straight section (vertical or otherwise) may alternatively be drilled with a PDM as in FIG. 1, whereby the drill string 12 is rotated along with the bit 18. In addition to assisting rotation of the bit 18, rotation of the drill string 12 keeps the bend 24 in constant motion, to ensure the bend 24 does not steer the hole in any particular direction away from the desired straight-line drilling path. When drilling a deviated section of the borehole with the PDM 14, the drill string 12 is instead slid without rotating while the PDM 14 continues to rotate the bit 18. The non-rotating bend 24, rotationally positioned as desired within the borehole, will then guide the drill string 12 to drill the deviated section.

Figure 3:
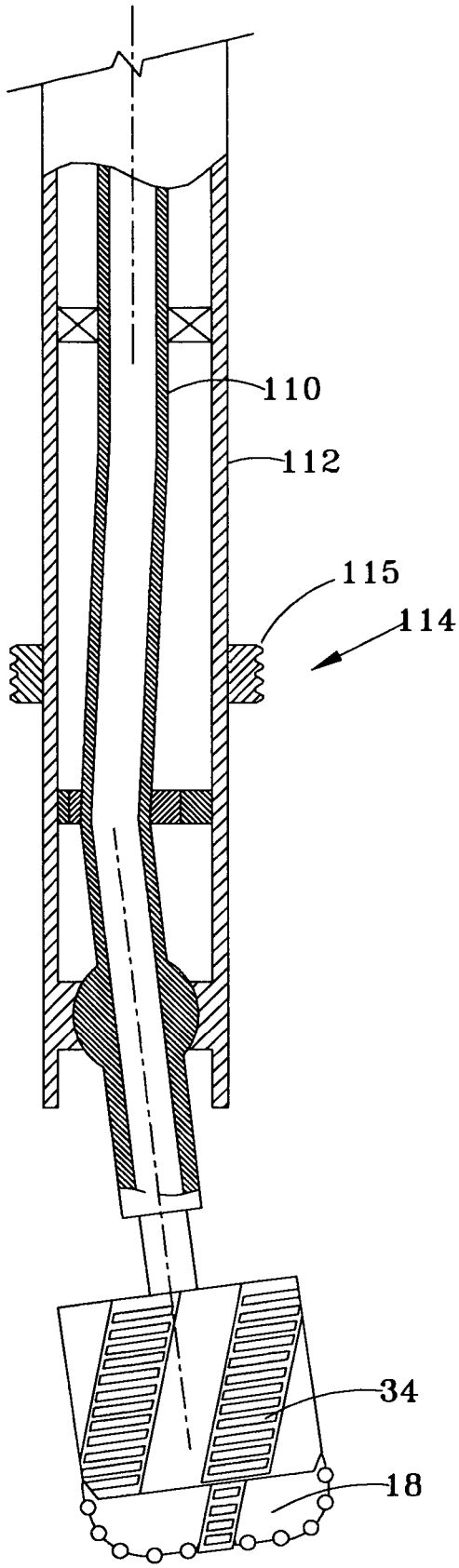
FIG. 3 illustrates an alternative embodiment, wherein the BHA includes a rotary steerable assembly (RSA) to allow simultaneous rotation of the drill string with the bit.

It is often desirable, even when drilling deviated sections, to rotate the drill string 12 and the bit 18 simultaneously to minimize the likelihood of the drill string 12 becoming stuck in the borehole and to improve return of cuttings to the surface. To accomplish this, the BHA may alternatively include a rotary steerable assembly (RSA) 114, as shown in FIG. 3. Whereas a PDM and BHM generally have a bend in their housings, an RSA has a drive shaft bend internal to a housing 112. The housing 112 surrounds the section of drill string 110 extending to the bit 118. The RSA includes a rotation prevention device 115, which engages the borehole wall and prevents or minimizes rotation of the housing 112. Unlike the PDM 14 as described in connection with FIG. 2, the RSA 114 allows a change in direction while rotating the string 110.

The term "downhole motor" as used herein includes a BHM/PDM or an RSA, which have in common an upper section (power section of a PDM or shaft guide section of an RSA) rotational axis and a lower bearing section with a rotational axis offset at a selected bend angle from the upper section central axis.

Referring back to FIG. 2, the bit 18 has a bit face 39, which includes a bit cutting surface 33. The bottom 38 of the gauge section 34 may be substantially at the same axial position as a bit face 39, but could be spaced slightly upward from the bit face 39. In drilling an optimally smooth borehole as described below, it is advantageous for the PDM to have a short "bit-to-bend" ratio. In a preferred embodiment of the invention incorporating a PDM, an axial spacing between the bend 24 and the bit face 39 is less than twelve times the bit diameter 32. For an RSA, by contrast, the bit-to-bend ratio is usually less crucial for achieving optimal borehole quality, because the bend is internal to the housing.

As further shown in FIG. 2, a gauge section 34 extends above the bit face 39, and is rotatably secured to and/or may be integral with the bit 18. An axial "gauge length" 35 of the gauge section 34 is measured from a top 31 of the gauge section 34 to the lowest full diameter point of the bit 18, i.e. from the top 31 of the gauge section 34 to at least approximately where the gauge section 34 meets the bit face 39. The axial length 35 of the gauge section may be expressed as a function of the bit diameter 32. In one embodiment of the invention, the gauge length is at least 60% of the bit diameter 32, preferably is at least 75% of the bit diameter 32, and in many applications may be from 90% to one and one-half times the bit diameter 32.

When the gauge section 34 rotates it sweeps a substantially uniform diameter profile, which may be referred to as the "cylindrical bearing surface" 36. This cylindrical bearing surface 36 is preferably continuous, but the gauge section 34 may be interrupted by one or more undergauge portions, such that the surface 36 is axially separated at one or more locations. In one embodiment of the invention, the aggregate length of the surface 36, however, is at least 50% of the gauge length 35. Those skilled in the art will appreciate that the gauge section 34 need not itself be cylindrical, but may commonly be provided with axially extending flutes along its length, generally arranged in a spiral pattern. In such embodiments, a major diameter associated with the axially extending flutes may define the cylindrical bearing surface 36 when rotating.

Figure 4:
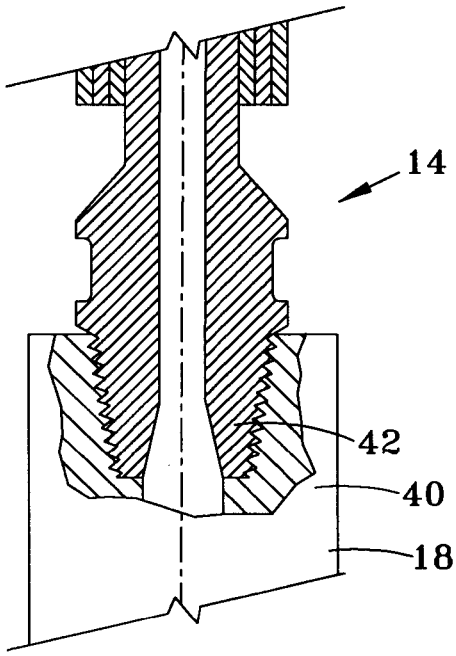
FIG. 4 illustrates the box connection on the bit connected with a pin connection on the motor.

In one embodiment of the invention, as shown in FIG. 4, a threaded box connection 40 may be provided on a bit 18 for threaded engagement with a threaded pin connection 42 at the lower end of the downhole motor 14. In one embodiment of the invention, the interconnection between the motor 14 and the bit 18 is thus made through the pin connection 42 on the motor 14 and the box connection 40 on the bit 18.

In one embodiment of the invention, the above approach to drilling a deviated portion of a wellbore, incorporating a long gauge section of at least 60% of the bit cutting diameter (and for non-RSA applications, further incorporating a short bit-to-bend ratio whereby the bit face is spaced from the bend no more than 12 times the bit diameter), provides superior borehole quality, such as by reducing spiraling and ensuring the borehole is smooth (substantially non spiraled) and uniform. With the borehole thus prepared, a fluid permeable tubular may be optimally inserted and expanded within the borehole, as discussed below.

Figure 7:
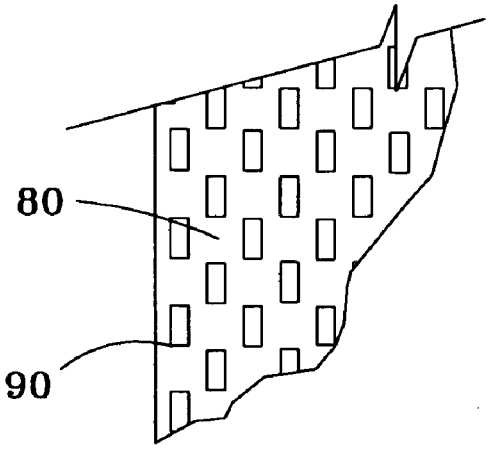
FIG. 7 illustrates in greater detail a section of "expandable sand screen" (ESS) used in the fluid-permeable tubular.

A fluid permeable tubular is generally a cylindrical tube made of metal such as steel, and having a plurality of perforations or holes through its wall that are capable of passing fluid. This is useful, for example, when positioning the tubular within an open-hole portion of a formation, for passing fluids from the formation and into the borehole for recovery. FIG. 7 conceptually illustrates in greater detail a section of material used in the fluid-permeable tubular 80. The sand screen is shown in an expanded configuration, having fluid-permeable perforations 90 through which hydrocarbons are conveyed. Although the perforations 90 are shown as rectangular, a variety of shapes and sizes of perforations are known in the art, including circular, rectangular, and slot-shaped perforations.

Figure 5:
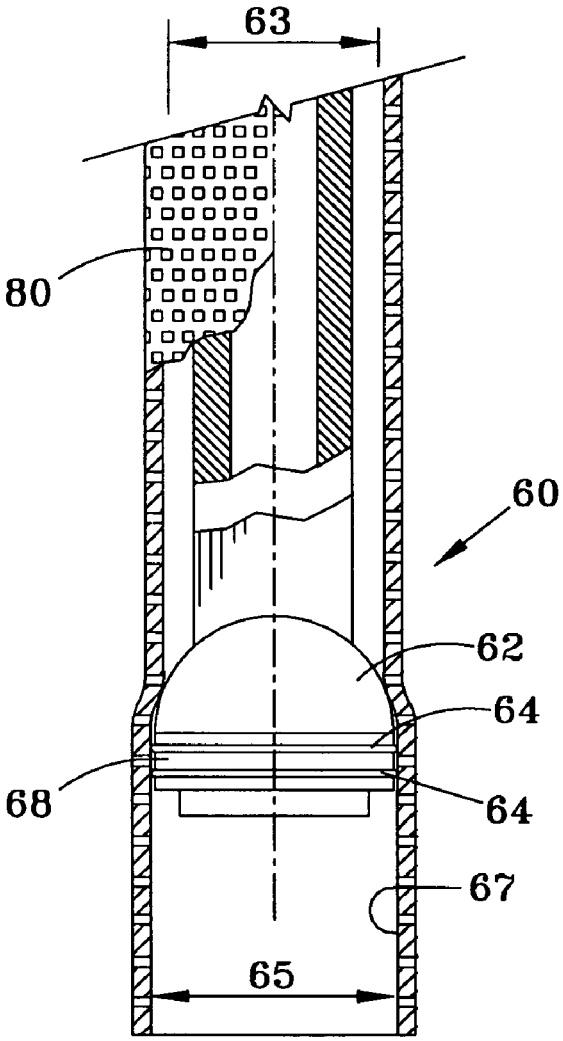
FIG. 5 illustrates one type of expansion tool for expanding a downhole tubular within a wellbore.

FIG. 5 conceptually illustrates one type of an expansion tool 60 suitable for expanding a fluid permeable tubular 80 downhole according to the invention. An expansion element 62 is included with the tool 60. Expansion element 62 may be sized according to the desired degree of expansion. Optional seal rings 64 seal with an internal diameter 67 of the expanded tubular 80. By forcibly moving the expansion element 62 axially within the fluid permeable tubular 80, the tool 60 expands the casing from an initial diameter 63 to an expanded diameter 65. The fluid permeable tubular preferably has an axial length of at least 150 times the initial diameter 63.

Figure 6:
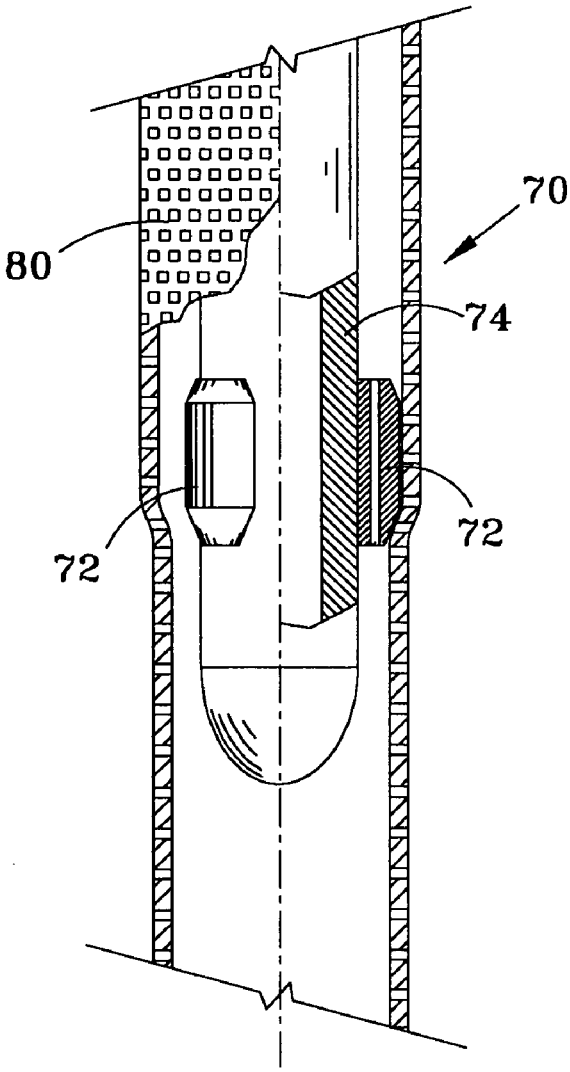
FIG. 6 illustrates an alternative type of expansion tool.

FIG. 6 conceptually illustrates an alternative expansion tool 70 which uses a plurality of rollers 72 to expand the fluid permeable tubular 80. Each of these rollers 72 rotates about a tool mandrel 74. The amount of expansion may depend on the resistance to expansion, if any, provided by the formation and/or an optional outer tubular engaged by the expanding tubular 80, because the axis of rotation for each roller may move radially relative to the expansion tool centerline.

The smooth, high quality wellbore made possible with the above drilling technique offers several advantages. One advantage is that the smoother borehole will allow the fluid permeable tubular 80 to be sized with a larger initial diameter 63 than what is otherwise possible with a lower quality borehole. This is ideal, because less expansion is then required to expand the tubular to the expanded diameter. This reduced expansion provides benefits such as a thinner wall thickness for a lower cost, enhanced post-expansion strength, and increased production.

Figure 8:
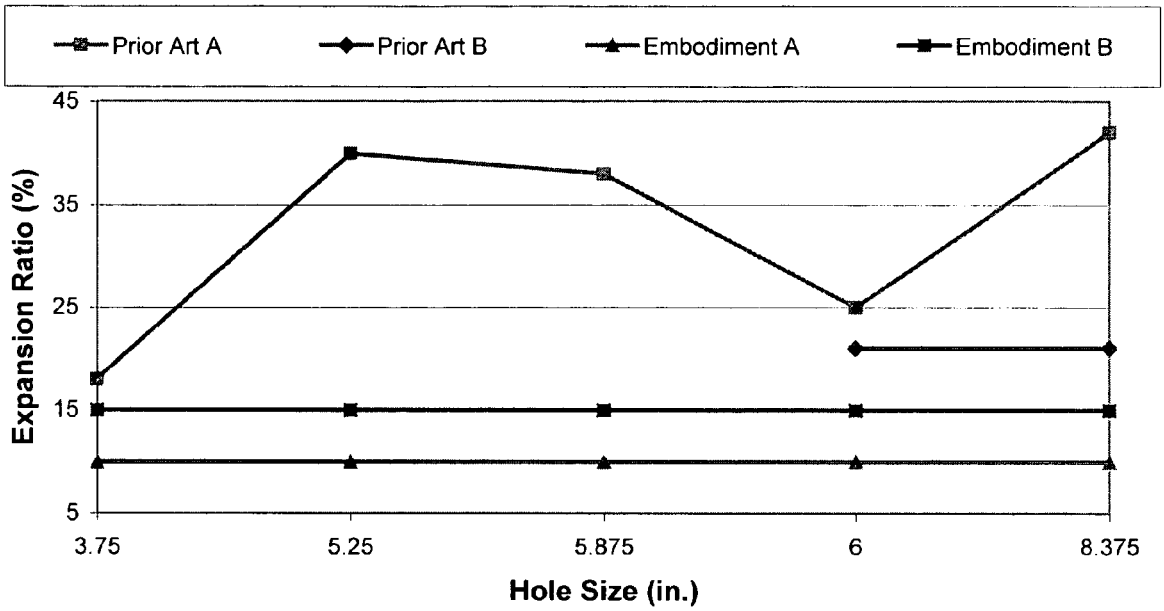
FIG. 8 compares typical expansion ratios of prior art systems and the invention over a range of perforation size.

The degree of expansion may be expressed as an expansion ratio, which is the percent increase in diameter due to expansion from the initial diameter to the final expanded diameter. FIG. 8 is an X-Y plot graphically comparing the expansion ratios of the two primary prior art systems with that obtainable with the invention. The values for the prior art system labeled "Prior Art A" range from a minimum of about 20%, up to as high as 50–60%, over a range of hole sizes. The values for the prior art system labeled "Prior Art B," which is typically practiced over the narrower range of hole sizes shown, is approximately 20%. By contrast, the invention allows a lower expansion ratio over a range of hole sizes. In a preferred embodiment of the invention, the fluid permeable tubular 80 may be sized such that a 15% radial expansion may be sufficient for the application, as represented by the curve labeled "Embodiment B." In more preferred embodiments, as little as 10% radial expansion may be required, as represented by the curve labeled "Embodiment A."

An expanded permeable tubular can be further characterized by a diameter-to-wall-thickness or "D/T" ratio, where D and T are the diameter and thickness of the tubular, respectively, prior to expansion. A higher D/T ratio is preferred, translating to a reduced thickness T for a given diameter D, minimizing weight and cost and increasing production yield. For the prior art systems, the D/T ratio ranges between approximately 7.4 and 15. In a preferred embodiment of the claimed invention, by contrast, a D/T ratio of 20 or higher is possible for some typical values of D. These elevated D/T ratios are generally not possible with the prior art due to the higher degree of expansion, which would likely lead to failure of the expanded tubular.

Conventional fluid permeable tubulars with expansion ratios of greater than 20 may require the use of materials or alloys in the manufacture of the tubulars that are capable of withstanding the comparatively larger expansion ratios as compared with the fluid permeable tubulars of the invention. The fluid permeable tubulars of the invention may therefore be manufactured with materials or alloys which are capable of expanding less as compared with conventional fluid permeable tubulars due to the smaller expansion ratios (typically less than about 20%). In addition, the manufacturing processes used to make conventional fluid permeable tubulars more expandable, e.g., heat tempering and liquid quenching may be modified to produce fluid permeable tubulars in accordance with the invention in a less expensive manner.

Because of the lower expansion ratio, a lower grade steel (that has a lower yield stress compared to conventional fluid permeable tubulars) may be used in the design of the fluid permeable tubular of the invention. For example, by changing the expansion ratio from 20% to 15% (a 25% reduction), the yield stress of the material used to manufacture the fluid permeable tubular according to one embodiment of the invention may potentially be reduced by 25%.

Figure 9:
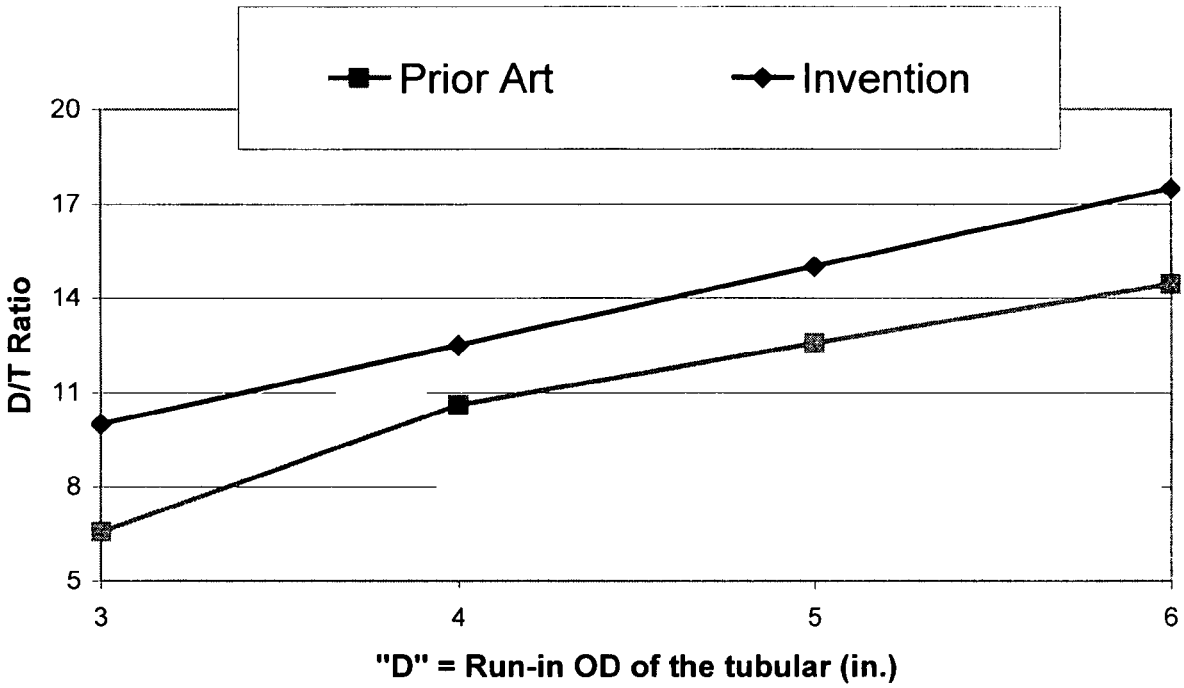
FIG. 9 compares the D/T ratio for two prior art systems and for the claimed system over a range of nominal outer diameter D of a permeable tubular prior to expansion.

In an embodiment of the present invention, the D/T ratio can be expressed as a function of D. FIG. 9 compares the diameter-to-wall-thickness or "D/T" ratio for a prior art system (labeled "Prior Art") with one embodiment of the claimed system (labeled "Invention"), over a range of nominal outer diameter D of a permeable tubular prior to expansion. The D/T ratio for the embodiment of the invention characterized in FIG. 9 can be approximated with the function:

$$\boxed{D/T \geq 10 + 2.5^{*}(D-3)}$$

where D and T are measured in inches. The D/T curve for this embodiment is consistently higher than that of the prior art shown. A related benefit of the improved D/T ratio is that the thinner wall thickness corresponds to an increased tubular ID, which increases volumetric fluid flow within the expanded tubular member.

Another benefit of the smooth, high quality borehole is that the fluid permeable tubular 80 may be pushed further through the borehole than in the prior art. Improved hole quality makes hole cleaning easier and facilitates insertion of the fluid permeable tubular 80, in part because the smoother borehole has reduced the drag caused due to at least the frictional forces with the formation borehole. The present invention allows the fluid permeable tubular 80 to be positioned further than 5000 feet into a substantially horizontal portion of the borehole. Such distances have generally been unobtainable in the fluid permeable tubular prior art.

Yet another benefit of having a smoother borehole is that the fluid permeable tubular 80 may be placed in more intimate contact with the formation, optimizing the benefits associated with an expandable tubular completion.

Figure 10:
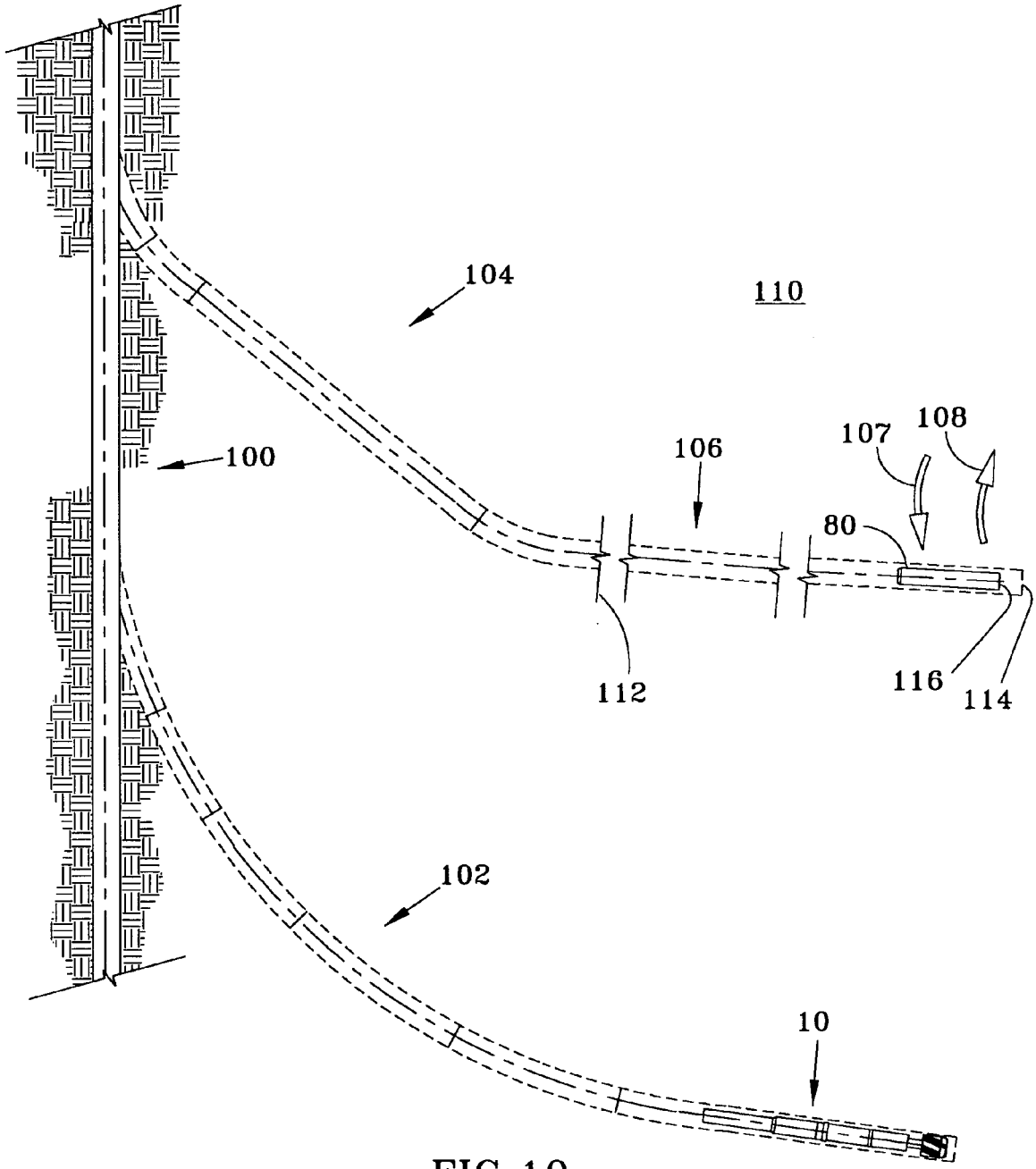
FIG. 10 conceptually shows a subterranean well system for production of wellbore fluids from a formation, which has been drilled and completed according to the invention.

FIG. 10 conceptually shows a subterranean well system for production of wellbore fluids such as oil or gas from a formation 110, which has been drilled and completed as described according to the present invention. A straight, vertical section 100 of the well has been drilled, typically with straight pipe sections and without the need for either an RSA or PDM. Deviated sections 102 and 104 have been drilled using an RSA or PDM, so the drilling path gradually and incrementally changes direction. Deviated section 102 is shown with the BHM 10 still in position for continued drilling of the deviated section 102. Deviated section 104 is shown having reached a substantially horizontal section 106, with fluid permeable tubular 80 inserted. Substantially horizontal section 106 extends a length measured from a point 112, at which the deviated section first reaches an approximately horizontal orientation, to an approximate end point 114. According to the present invention, the length between points 112 and 114 may exceed 5000 feet. At least a portion of fluid permeable tubular 80, such as distal end 116, may thus extend more than 5000 feet in the substantially horizontal direction. With fluid permeable tubular 80 in place, hydrocarbons may be recovered from the formation 110 along a flow path shown generally at 107. A well completed in this manner may alternatively be used for injection of fluid into the formation 110 through the fluid permeable tubular member 80 along a flow path shown generally at 108.

While preferred embodiments of the present invention have been illustrated in detail, modifications and adaptations of the preferred embodiments may occur to those skilled in the art. It is to be expressly understood, however, that such modifications and adaptations are within the scope of the present invention as set forth in the following claims.

The invention claimed is:

1. A method of drilling a deviated portion of a borehole and positioning a fluid permeable tubular therein, comprising:

positioning a bottom hole assembly downhole, the bottom hole assembly including a downhole motor with a drill shaft having an upper section with an upper central rotational axis and a lower central rotational axis offset at a bend having a selected bend angle from the upper central rotational axis, a bit having a bit face, and a gauge section, the bit face defining a bit cutting diameter, the gauge section having an axial length of at least 60% of the bit culling diameter;

rotating the bit and the gauge section to drill a deviated portion of a borehole;

inserting a fluid permeable tubular having a run-in diameter at a desired location within the deviated portion of the borehole, the axial length of the fluid permeable tubular being at least 150 times the run-in diameter of the fluid permeable tubular; and radially expanding the fluid permeable tubular within the drilled borehole portion to an expanded diameter greater than the run-in diameter.

2. A method as defined in claim 1, wherein radially expanding the downhole fluid permeable tubular to the expanded diameter comprises radially expanding the fluid permeable tubular to be in contact with an open hole portion of the wellbore.

3. A method as defined in claim 1, wherein the bottom hole assembly comprises:

one of a positive displacement motor and a rotary steerable assembly.

4. A method as defined in claim 1, wherein the bottom hole assembly comprises a positive displacement motor, and wherein an axial spacing between the bend and the bit face is less than 12 times the bit cutting diameter.

5. A method as defined in claim 1, wherein the gauge section has an axial length of at least 75% of the bit cutting diameter.

6. A method as defined in claim 1, wherein at least 50% of the axial length of the gauge section has a uniform diameter cylindrical bearing surface.

7. A method as defined in claim 1, wherein the run-in diameter of the fluid permeable tubular requires less than 15% expansion downhole.

8. A method as defined in claim 1, wherein the run-in diameter of the fluid permeable tubular requires less than 10% expansion downhole.

9. A method as defined in claim 1, wherein the ratio of the run-in diameter to a wall thickness of the tubular member is expressed by the function:

$$D/T \geqq 10+2.5*(D-3)$$

where D is the run-in diameter and T is the wall thickness measured in inches.

10. A method as defined in claim 1, wherein the ratio of the run-in diameter to a wall thickness of the tubular member is at least 20.

11. A method as defined in claim 1, further comprising:

drilling the deviated portion of the borehole more than 5000 feet in a substantially horizontal direction; and positioning at least a portion of the fluid permeable tubular member more than 5000 feet in the substantially horizontal direction within the deviated portion of the borehole.

12. A method as defined in claim 1, wherein rotating the bit comprises:

at least one of pumping fluid through the downhole motor and rotating the drill string from the surface.

13. A method of drilling a deviated portion of a borehole and positioning a fluid permeable tubular therein, comprising:

positioning a bottom hole assembly downhole, the bottom hole assembly including a downhole motor with a drill shaft having an upper section with an upper central rotational axis and a lower central rotational axis offset at a selected bend angle from the upper central axis, a bit including a bit face, and a gauge section, the bit face defining a bit cutting diameter, the gauge section having an axial length of at least 75% of the bit cutting diameter;

rotating the bit and the gauge section to drill a deviated portion of a borehole;

inserting a fluid permeable tubular with a run-in diameter at a desired location within the deviated portion of the borehole, the run-in diameter selected to expand less than 15%, the axial length of the fluid permeable tubular being at least 150 times the run-in diameter of the fluid permeable tubular; and radially expanding the downhole fluid permeable tubular within the borehole to place the fluid permeable tubular in contact with a wall of the borehole.

14. A method as defined in claim 13, wherein at least 50% of the axial length of the gauge section has a uniform diameter cylindrical bearing surface.

15. A method as defined in claim 13, wherein the downhole fluid permeable tubular is radially expanded less than 10%.

16. A method as defined in claim 14, wherein the ratio of the run-in diameter to a wall thickness of the tubular member is expressed by the function:

$$D/T \geqq 10+2.5*(D-3)$$

where D is the run-in diameter and T is the wall thickness, measured in inches.

17. A method as defined in claim 13, wherein the ratio of the run-in diameter to a wall thickness of the tubular member is at least 20.

18. A method as defined in claim 13, wherein the bottom hole assembly comprises:

one of a positive displacement motor and a rotary steerable assembly.

19. A method as defined in claim 13, further comprising:

drilling the deviated portion of the borehole more than 5000 feet in a substantially horizontal direction; and positioning at least a portion of the fluid permeable tubular member more than 5000 feet in the substantially horizontal direction within the deviated portion of the borehole.

20. A method as defined in claim 13, wherein rotating the bit comprises:

at least one of pumping fluid through the downhole motor and rotating the drill string from the surface.

21. A method as defined in claim 13, further comprising:

recovering hydrocarbons from the formation through the fluid permeable tubular.

22. A subterranean well system comprising:

a bottom hole assembly including a downhole motor with a drill shaft having an upper section with an upper central rotational axis and a lower central rotational axis offset by a bend at a selected bend angle from the upper central rotational axis;

a bit having a bit face and a gauge section, the bit face defining a bit cutting diameter, the gauge section having an axial length of at least 60% of the bit cutting diameter, to drill a deviated borehole portion of a well; and a fluid permeable tubular inserted in the deviated borehole portion and having a run-in diameter, the fluid permeable tubular radially expanded to an expanded diameter greater than the run-in diameter to place the expanded diameter fluid permeable tubular in contact with the deviated borehole portion of the well.

23. A subterranean well system as defined in claim 22, wherein the bottom hole assembly comprises:

at least one of a positive displacement motor and a rotary steerable assembly.

24. A subterranean well system as defined in claim 22, wherein the bottom hole assembly comprises a positive displacement motor, and wherein an axial spacing between the bend and the bit face is less than 12 times the bit cutting diameter.

25. A subterranean well system as defined in claim 22, wherein the gauge section has an axial length of at least 75% of the bit cutting diameter.

26. A subterranean well system as defined in claim 22, wherein at least 50% of the axial length of the gauge section has the uniform diameter cylindrical bearing surface.

27. A subterranean well system as defined in claim 22, wherein the run-in diameter of the fluid permeable tubular requires less than 15% expansion downhole.

28. A subterranean well system as defined in claim 22, wherein the run-in diameter of the fluid permeable tubular requires less than 10% expansion downhole.

29. A subterranean well system as defined in claim 24, wherein the ratio of the run-in diameter to a wall thickness of the tubular member is expressed by the function:

$$D/T \geqq 10+2.5*(\text{i } D-3)$$

where D is the run-in diameter and T is the wall thickness measured in inches.

30. A subterranean well system as defined in claim 22, wherein the ratio of the run-in diameter to a wall thickness of the tubular member is at least 20.

31. A subterranean well system as defined in claim 22, wherein an axial length of the fluid permeable tubular is at least 150 times the run-in diameter of the fluid permeable tubular.

32. A subterranean well system as defined in claim 22, further comprising:

the deviated borehole portion of the well extending more than 5000 feet in a substantially horizontal direction; and at least a portion of the fluid permeable tubular member positioned more than 5000 feet in the substantially horizontal direction within the deviated borehole portion of the well.

* * * * *

UNITED STATES PATENT AND TRADEMARK OFFICE

CERTIFICATE OF CORRECTION

PATENT NO. : 7,066,271 B2
APPLICATION NO. : 10/721042
DATED : June 27, 2006
INVENTOR(S) : ChenKang David Chen, Daniel David Gleitman and M. Vikram Rao It is certified that error appears in the above-identified patent and that said Letters Patent is hereby corrected as shown below:

In column 8, line 34, Claim 16, line 1, delete "14" and insert therefor --13--.

In column 10, line 4, Claim 29, line 1, delete "24" and insert therefor --22--.

Signed and Sealed this

Twenty-fourth Day of October, 2006

JON W. DUDAS
*Director of the United States Patent and Trademark Office*